US010512934B2

(12) United States Patent
Matin et al.

(10) Patent No.: US 10,512,934 B2
(45) **Date of Patent: *Dec. 24, 2019**

(54) METHOD FOR PREPARING A SUPERHYDROPHOBIC SELF-CLEANING SURFACE

(71) Applicant: KING FAHD UNIVERSITY OF PETROLEUM AND MINERALS, Dhahran (SA)

(72) Inventors: Asif Matin, Dhahran (SA); Necar Merah, Dhahran (SA)

(73) Assignee: King Fahd University of Petroleum and Minerals, Dhahran (SA)

( * ) Notice: Subject to any disclaimer, the term of this patent is extended or adjusted under 35 U.S.C. 154(b) by 0 days.

This patent is subject to a terminal disclaimer.

(21) Appl. No.: 16/178,013

(22) Filed: Nov. 1, 2018

(65) Prior Publication Data

US 2019/0070633 A1 Mar. 7, 2019

Related U.S. Application Data

(63) Continuation of application No. 15/387,142, filed on Dec. 21, 2016, now Pat. No. 10,150,140.

(Continued)

(51) Int. Cl.
*B05D 5/08* (2006.01)
*B05D 3/14* (2006.01)

(52) U.S. Cl.
CPC ..... *B05D 5/08* (2013.01); *B05D 3/142* (2013.01); *B05D 2201/00* (2013.01); *B05D 2203/35* (2013.01); *B05D 2518/12* (2013.01)

(58) Field of Classification Search
CPC ..... B05D 5/08; B05D 3/142; B05D 2201/00; B05D 2203/35; B05D 2518/12
See application file for complete search history.

(56) References Cited

U.S. PATENT DOCUMENTS 6,660,363 B1 12/2003 Barthlott
7,635,652 B2 12/2009 Chang
(Continued)

FOREIGN PATENT DOCUMENTS

KR 20060080642 A 7/2006
WO WO 97/07429 2/1997
WO WO 2009/100757 A1 8/2009

OTHER PUBLICATIONS

N. Glass, et al., "Organosilane Deposition for microfluidic applications" Biomicrofluidics, vol. 5, Aug. 16, 2011, pp. 036501-1-036501-7.

(Continued)

*Primary Examiner* — Hai Vo
(74) *Attorney, Agent, or Firm* — Oblon, McClelland, Maier & Neustadt, L.L.P.

(57) ABSTRACT

A superhydrophobic and self-cleaning surface including a substrate and a superhydrophobic layer. The superhydrophobic layer having a reacted form of octadecyltrichlorosilane. The octadecyltrichlorosilane is disposed on and crosslinked to a surface of the substrate via surface hydroxyl groups. The surface exhibits a rms roughness of 40 nm to 60 nm, a water contact angle of 155° to 180°, and a contact angle hysteresis of less than 15°. A method of preparing the substrate with a superhydrophobic and self-cleaning surface including treating a substrate with a plasma treatment, contacting the substrate with water or an alcohol to form an hydroxylated substrate, contacting the hydroxylated substrate with a solution of octadecyltrichlorosilane in an alkane solvent at a concentration in the range of 0.05 M to 0.3 M, and drying the solution on to the substrate under ambient air to form the superhydrophobic and self-cleaning surface on the substrate.

6 Claims, 7 Drawing Sheets

Related U.S. Application Data

(60) Provisional application No. 62/293,159, filed on Feb. 9, 2016.

(56) References Cited

U.S. PATENT DOCUMENTS

| | | | |
|---|---|---|---|
| 2003/0138823 | A1 | 7/2003 | Brock et al. |
| 2004/0033639 | A1 | 2/2004 | Chinn |
| 2006/0240218 | A1 | 10/2006 | Parce |
| 2008/0241512 | A1 | 10/2008 | Boris |
| 2008/0250978 | A1 | 10/2008 | Baumgart et al. |
| 2010/0029460 | A1 | 2/2010 | Shojiya |

OTHER PUBLICATIONS

G. Carson, et al., "Self-Assembly of Octadecyltrichlorosilane Films on Mica" Journal of Applied Polymer Science, vol. 37, 1989 pp. 2767-2772.

Y. Song, et al. "Superhydrophobic surfaces produced by applying a self-assembled monolayer to silicon micro/ nano-textured surfaces" Nano Research, Mar. 5, 2010, vol. 2, Issue 2, pp. 143-150.

R = Cl, $OR_1$, OH, polysilane, polyfluorosilane $R_1$= $(CH_2)_nCH_3$, OH, H

X = alkane chain 301
302
303

METHOD FOR PREPARING A SUPERHYDROPHOBIC SELF-CLEANING SURFACE

CROSS REFERENCE TO RELATED APPLICATIONS

The present application is a Continuation of Ser. No. 15/387,142, now allowed, having a filing date of Dec. 21, 2016 and which claims benefit of priority to U.S. provisional application No. 62/293,159 having a filing date of Feb. 9, 2016, which is incorporated herein by reference in its entirety.

STATEMENT OF ACKNOWLEDGEMENT

This project was funded by the Center for Clean Water and Clean Energy at King Fand University of Petroleum & Minerals under project number R16-DMN-11.

BACKGROUND OF THE INVENTION

Technical Field

The present invention relates to a substrate and a method of coating a substrate having superhydrophobic and self-cleaning properties.

Description of the Related Art

The "background" description provided herein is for the purpose of generally presenting the context of the disclosure. Work of the presently named inventors, to the extent it is described in this background section, as well as aspects of the description which may not otherwise qualify as prior art at the time of filing, are neither expressly or impliedly admitted as prior art against the present invention.

Non-wetting surfaces are important for several industrial applications such as textiles, electronic devices, battery and fuel cells, etc. Many biological surfaces, particularly some plant leaves, exhibit remarkable non-wetting characteristics. See K. Koch, W. Barthlott, Superhydrophobic and superhydrophilic plant surfaces: an inspiration for biomimetic materials, Philos. T. Roy. Soc. A 367 (2009) 1487-1509 and S. S. Latthe, C. Terashima, K. Nakata, A. Fujishima, Superhydrophobic surfaces developed by mimicking hierarchical surface morphology of lotus leaf, Molecules 19 (2014) 4256-83, each incorporated herein by reference in their entirety. The well-known superhydrophobicity of lotus leaves have attracted a lot of attention and have generated interest in fundamental research, as well as in industrial applications. See W. Barthlott, C. Neinhuis, Purity of the sacred lotus, or escape from contamination in biological surfaces, Planta 202 (1997) 1-8, incorporated herein by reference in its entirety. Further, it is well-known that there are two major factors influencing the wettability of a solid surface: surface chemistry, and surface topology. See X. Feng, L. Feng, M. Jin, J. Zhai, L. Jiang, D. Zhu, Reversible super-hydrophobicity to super-hydrophilicity transition of aligned ZnO nanorod films, J. Am. Chem. Soc. 126 (2003) 62-63, incorporated herein by reference in its entirety. An appropriate combination of a chemical composition that gives low surface energy and a morphology that results in intermediate surface roughness usually result in superhydrophobic behavior.

A wide variety of methods have been adopted to synthesize water-repellent surfaces and their possible applications.

See Y.-K. Lai, Z. Chen, C. J. Lin, Recent progress on the superhydrophobic surfaces with special adhesion: from natural to biomimetic to functional, *J. Nanoeng. Nanomanuf.* 1 (2011) 18-34; E. Celia, T. Darmanin, E. Taffin de Givenchy, S. Amigoni, F. Guittard, Recent advances in designing superhydrophobic surfaces, *J. Colloid Interf. Sci.* 402 (2013) 1-18; N. Valipour M, F. C. Birjandi, J. Sargolzaei, Super-non-wettable surfaces: a review, *Colloid Surface A* 448 (2014) 93-106, each incorporated herein by reference in their entirety. Several researchers have tried to fabricate patterned surfaces with superhydrophobic characteristics using expensive instrumentation and cumbersome procedures. See A. Hozumi, O. Takai, Preparation of ultra-water-repellent films by microwave plasma-enhanced CVD, *Thin Solid Films* 303 (1997) 222, incorporated herein by reference in its entirety. Moreover, some routes for creation of such surfaces require the repetition of the entire experimental process, which is time-consuming and laborious; hence diminishing their feasibility. See Y. S. Choi, J. S. Lee, S. B. Jin, J. G. Han, Super-hydrophobic coatings with nano-size roughness prepared with simple PECVD method, *J. Phys. D: Appl. Phys.* 46 (2013) 315-321; J. M. Schakenraad, I. Stokroos, H. Bartels, H. J. Busscher, Patency of small calibre, superhydrophobic E-PTFE vascular grafts (a pilot-study in rabbit carotid artery, *Cells Mater.* 2 (1992) 193; J. D. Miller, S. Veeramasuneni, J. Drelich, M. R. Yalamanchili, Y. Yamauchi, Effect of roughness as determined by atomic force microscopy on the wetting properties of PTFE thin films, *Polym. Eng. Sci.* 36 (1996) 1849, each incorporated herein by reference in their entirety. Therefore, the development of a simple and straightforward technique for preparing superhydrophobic surfaces is currently a major challenge in the area of surface science and technology.

In view of the forgoing, one objective of the present invention is to provide a superhydrophobic and self-cleaning substrate and a method for the fabrication of the superhydrophobic and self-cleaning substrate.

BRIEF SUMMARY OF THE INVENTION

According to a first aspect, the present disclosure relates to a substrate with a superhydrophobic and self-cleaning surface including a substrate and a superhydrophobic layer including octadecyltrichlorosilane in reacted form. The octadecyltrichlorosilane is disposed on and crosslinked to a surface of the substrate via surface hydroxyl groups. The substrate with the superhydrophobic and self-cleaning surface exhibits a root mean square roughness of 40 nm to 60 nm a water contact angle of 155° to 180° and a contact angle hysteresis of less than 15°, and the substrate is superhydrophobic and self-cleaning.

In some embodiments, the substrate is a glass, a hard plastic, a non-woven fabric, a cotton fabric, a non-woven synthetic polymer fabric, or a combination thereof.

In some embodiments, the superhydrophobic layer has protrusions which have a height from peak to valley in the range of 0.9 nanometers to 500 nanometers.

In some embodiments, the protrusions have a peak width in the range of 40 nm to 110 nm.

In some embodiments, the superhydrophobic layer comprises pores having a pore size in the range of 140 nm to 260 nm and a mean pore size of 200 nm.

In some embodiments, the substrate with a superhydrophobic and self-cleaning surface is resistant to particles having a size of at least 0.8 micron.

In some embodiments, the superhydrophobic layer comprises a network of cylindrical fibers.

In some embodiments, the cylindrical fibers have a diameter in the range of 45 nm to 100 nm.

In some embodiments, the reacted form of the octadecyltrichlorosilane

According to a second aspect, the present disclosure relates to a method of preparing a substrate with a superhydrophobic and self-cleaning surface including treating a substrate with a plasma treatment under a reduced pressure of 0.5 atm to $1\times10^{-10}$ atm, removing the substrate from the reduced pressure and contacting the substrate with water, an alcohol, or both to form a hydroxylated substrate, contacting the hydroxylated substrate with a solution comprising octadecyltrichlorosilane and an alkane solvent, wherein a concentration of the octadecyltrichlorosilane in the alkane solvent is in the range of 0.05 M to 0.3 M and drying the solution on to the substrate under air to form the superhydrophobic and self-cleaning surface on the substrate.

In some implementations, the plasma treatment is at least one selected from the group consisting of an oxygen plasma, an argon plasma treatment, and a nitrogen plasma treatment.

In some implementations, the alkane is hexane.

In some implementations, the drying is under a heated air stream.

In some implementations, the treating is for 1 minute to 5 minutes under a vacuum.

In some implementations, the method further includes a second contacting of the dried substrate with a superhydrophobic and self-cleaning surface with a second solution of an octadecyltrichlorosilane, a reactive polyoctadecylsilane, or a combination thereof in an alkane solvent at a concentration in the range of 0.05 M to 2 M and a second drying of the solution under air.

In some implementations, the substrate is a glass, a hard plastic, a non-woven fabric, a cotton fabric, a non-woven synthetic polymer fabric, or a combination thereof.

In some implementations, the superhydrophobic and self-cleaning surface comprises a network of cylindrical fibers having a diameter in the range of 45 nm to 100 nm.

In some implementations, the superhydrophobic and self-cleaning surface exhibits a root mean square roughness of 40 nm to 60 nm, a water contact angle of 155° to 180° and a contact angle hysteresis of less than 15°.

The foregoing paragraphs have been provided by way of general introduction, and are not intended to limit the scope of the following claims. The described embodiments, together with further advantages, will be best understood by reference to the following detailed description taken in conjunction with the accompanying drawings.

BRIEF DESCRIPTION OF THE DRAWINGS

A more complete appreciation of the disclosure and many of the attendant advantages thereof will be readily obtained as the same becomes better understood by reference to the following detailed description when considered in connection with the accompanying drawings, wherein.

DETAILED DESCRIPTION OF THE EMBODIMENTS

Figure 1A:
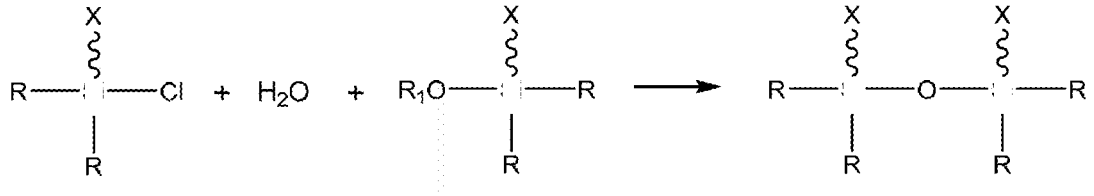
FIG. 1A is a diagram of a generalized crosslinking reaction between two substituted silane molecules.

Referring now to the drawings, wherein like reference numerals designate identical or corresponding parts throughout the several views.

The term "superhydrophobic" as used herein refers to the property of being or making an extremely hydrophobic surface, i.e., a surface that is extremely difficult to wet. The notion of using the contact angle made by a droplet of liquid on a surface of a solid substrate as a quantitative measure of the wetting ability of the particular solid has also long been well understood. Wetting is the ability of a liquid to maintain contact with a solid surface, resulting from intermolecular interactions when the two are brought together. The degree of wetting (wettability) is determined by a force balance between adhesive and cohesive forces. If the contact angle is greater than 90° for the water droplet to the substrate surface then it is usually considered to be hydrophobic. For example, there are materials on which liquid droplets have high contact angles, such as water on paraffin, for which there is a contact angle of about 107°. Many applications require a hydrophobic coating with a high contact angle of at least 150°, and preferably at least 165°. Such coatings are referred to as superhydrophobic coatings.

As used herein, the term "contact angle" is referred to as the angle between a static drop of deionized water and a flat and horizontal surface upon which the droplet is placed. The contact is conventionally measured through the liquid, where a liquid/vapor interface meets a solid surface, and quantifies the wettability of a solid surface by a liquid. The higher the contact angle, the higher the hydrophobic interaction between the surface and the liquid. Sliding angle or roll-off angle is defined as the angle between the sample surface and the horizontal plane at which the liquid drop starts to slide off the sample surface under the influence of gravitational force, also known as the tilting base method. For example, if a liquid spreads completely on the surface and forms a film, the contact angle is zero degrees (0°). As the contact angle incrcases, the wetting resistance incrcases, up to a theoretical maximum of 180°, where the liquid forms spherical drops on the surface. The term "wet-proof" is used to describe surfaces having a high wetting resist, to a particular reference liquid; "hydrophobic" is a term used to describe a wetting resistant surface where the reference liquid is water.

The contact angle formed between a liquid and solid phase may exhibit a range of contact angles that are possible. There are two common methods for measuring this range of contact angles. The first method is referred to as the tilting base method, as described above, which is also used to measure the sliding angle. Once a drop is dispensed on the surface with the surface level, the surface is then tilted from 0° to 90°. As the surface is tilted, the downhill side will be in a state of imminent wetting while the uphill side will be in a state of imminent dewetting (i.e. oiling of a water droplet downhill over the surface). As the tilt incrcases the downhill contact angle will incrcase and represents the advancing contact angle while the uphill side will decrcase; this is the receding contact angle. The values for these angles just prior to the drop releasing will typically represent the advancing and receding contact angles. The difference between these two angles is the contact angle hysteresis. A contact angle hysteresis below 15° is an indicator of potential self-cleaning properties of the surface. The second method is often referred to as the add/remove volume method. When the maximum liquid volume is removed from the drop without the interfacial area decreasing the receding contact angle is this measured. When volume is added to the maximum before the interfacial area increases, this is the advancing contact angle. As with the tilt method, the difference between the advancing and receding contact angles is the contact angle hysteresis. Most researchers prefer the tilt method; the add/remove method requires that a tip or needle stay embedded in the drop which can affect the accuracy of the values, especially the receding contact angle. Thus the lower the contact angle hysteresis the more wet-proof the surface.

An aspect of the present disclosure relates to a substrate having a surface with hydroxyl groups reacted with a superhydrophobic layer. The superhydrophobic layer includes a reacted form of an octadecyltrichlorosilane bonded to the surface via the dehydration of hydroxyl groups, a reacted form of an octadecyldichlorosilane, a reacted form of an octadecylchlorosilane, a polyoctadecylsilane, or a combination thereof. The octadecyltrichlorosilane is drop-coated on to the surface of the substrate and crosslinking does not require any catalyst.

Figure 1B:
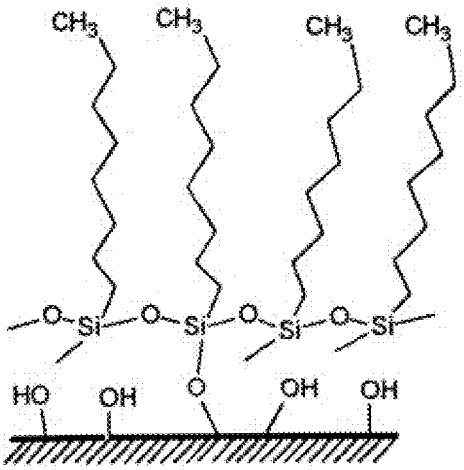
FIG. 1B is a schematic of an exemplary alkylsilane reaction horizontally with hydroxyl groups on a surface.
Figure 1C:
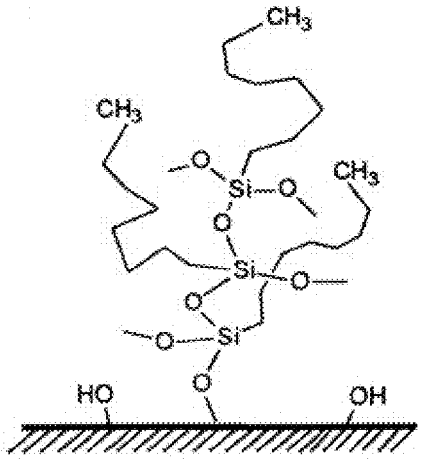
FIG. 1C is a schematic of an exemplary alkylsilane reaction vertically with adjacent alkylsilanes.

Octadecyltrichlorosilane (ODTS) is an organometallic chemical which is commonly used in the semiconductor industry to form thin films on silicon dioxide substrates. In the present disclosure the ODTS will crosslink with hydroxyl groups on a substrate formed by plasma cleaning and hydroxylation, then crosslinking may occur across a horizontal surface or vertically with unreacted or partially reacted ODTS molecules (i.e. having one or two chlorine atoms substituting silane). ODTS crosslinking may occur in a 3-step process: (i) hydrolysis of chloro-moieties of the ODTS to generate at least one of a derivative of octadecylsilane (ODS), octadecyldichlorosilanol, octadecylmonochlorosilane-di-ol, or octadecylsilane-tri-ol, (ii) physisorption onto the substrate via hydrogen bonding between the hydroxyl groups of each of the octadecylsilane derivatives to bring the molecules into close proximity just prior to hydrolysis, (iii) formation of bonds with the substrate via hydroxyl groups as well as cross-linking adjacent chains of ODTS molecules and ODS derivatives. Water for the hydrolysis step may be found in impure solvents employed in the preparation of the surface, or as described in the methods herein. FIG. 1A depicts a generalized chemical reaction between two substituted alkylsilane molecules. FIG. 1B depicts a schematic drawing showing possible products of the reaction of alkylchlorosilanes with hydroxylated surfaces due to horizontal polymerization. FIG. 1C depicts a schematic drawing showing possible products of the reaction of alkylchlorosilanes forming a 3D polysiloxane network due to vertical polymerization. Vertical polymerization may be described as ODTS molecules having at least one bond with the surface are crosslinked to at least one ODTS molecule that is not bonded to the surface. The presently disclosed superhydrophobic and self-cleaning substrate includes 60% to 90% or 70% to 80% of the total surface covered by vertically polymerized ODTS whereas 30% to 50% or 35% to 45% of the superhydrophobic and self-cleaning substrate includes horizontally polymerized ODTS forming a monolayer. In some embodiments, the reacted form of the octadecyltrichlorosilane, the reacted form of the octadecyldichlorosilane and the reacted form of octadecylchlorosilane are each hydrolyzed at the site of at least one chlorine and crosslinked by a condensation reaction to at least one hydroxyl on the substrate, or an octadecylmonochlorosilane, an octadecyldichlorosilane, or a polyoctadecylsilane having at least one unreacted chloro moiety.

The superhydrophobic layer is characterized by a network of cylindrical fibers having pores in between the fibers. In some embodiments, the cylindrical fibers have a diameter in the range of 45 nm to 100 nm, 50 nm to 90 nm, 55 nm to 80 nm, 60 nm to 75 nm, or 65 nm to 70 nm. The fibers may be a combination of horizontal polymers and vertical polymers of silane compounds as described herein.

Figure 2A:
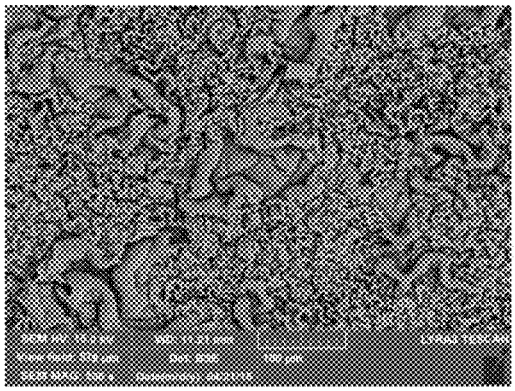
FIG. 2A is a scanning electron microscope view of a superhydrophobic and self-cleaning surface at 500× magnification.
Figure 2B:
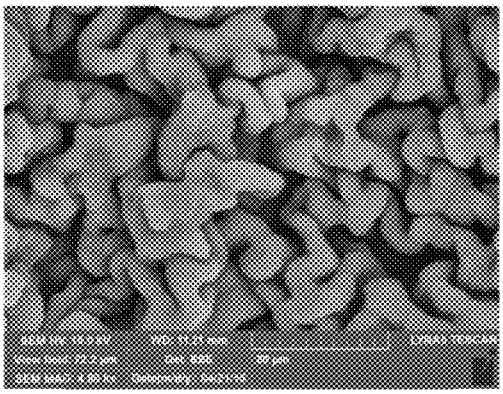
FIG. 2B is a scanning electron microscope view of the superhydrophobic and self-cleaning surface at 4000× magnification.
Figure 2C:
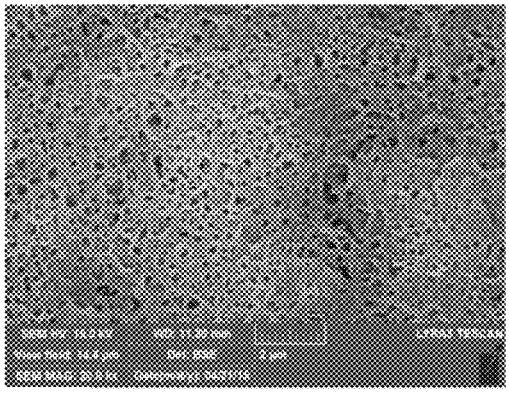
FIG. 2C is a scanning electron microscope view of the superhydrophobic and self-cleaning surface at 20000× magnification.
Figure 2D:
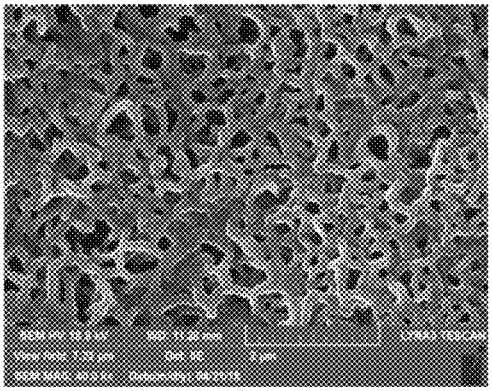
FIG. 2D is a scanning electron microscope view of the superhydrophobic and self-cleaning surface at 40000× magnification.
Figure 2E:
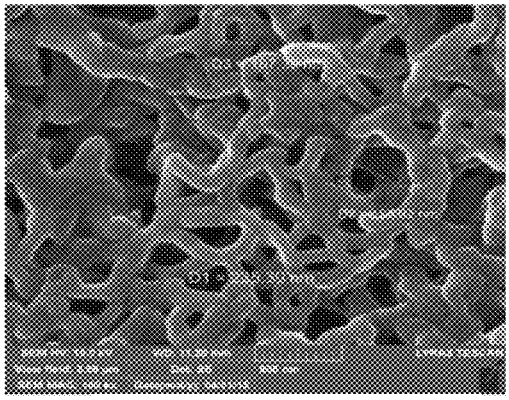
FIG. 2E is a scanning electron microscope view of the superhydrophobic and self-cleaning surface at 100000× magnification.
Figure 2F:
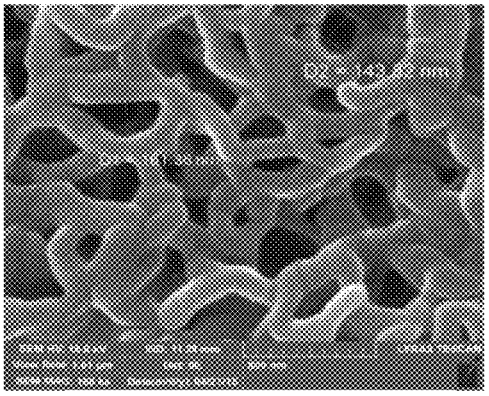
FIG. 2F is a scanning electron microscope view of the superhydrophobic and self-cleaning surface at 150000× magnification.

FIG. 2A through FIG. 2F depict scanning electron microscope (SEM) images of the surfaces of the superhydrophobic and self-cleaning substrate. FIG. 2A at 500× magnification depicts 578 micron field of view of the surface showing a wrinkled appearance. Magnifying to 4000×, FIG. 2B depicts an SEM image of a 72.2 micron field depicting individual "wrinkle-like" structure that appears in FIG. 2A. At 20000×, FIG. 2C depicts an SEM image of one of the "wrinkle-like" structures to further expose crisscrossing cylindrical fibers, described above as a network of cylindrical fibers in a noodle-like structure, and spaces between the fibers referred to as pores. FIG. 2D, FIG. 2E, and FIG. 2F depict further magnified SEM images, 40000×, 100000×, and 160000×, respectively, depicting a field of 7.22 micron, 2.89 micron, and 1.81 micron, respectively showing the cylindrical fibers forming a network and depicting the pores between the fibers. The opaque fibers indicate that the fibers comprise multiple layers of thickness of the ODTS forming the 3D network of the noodle-like structures; whereas in some embodiments of the superhydrophobic and self-cleaning substrate, self-assembled monolayers of ODTS may be highly transparent to visible light. The pores are non-uniform shapes, but generally circular or elliptical in shape and have a pore size in the range of 140 nm to 260 nm and a mean pore size of 200 nm. The superhydrophobic characteristic of the superhydrophobic and self-cleaning substrate is dependent on this porous morphology of the superhydrophobic layer. The pores trap air, which contributes to a high water contact angle and a low contact angle hysteresis. The substrate exhibits a water contact angle of 155° to 180°, 157° to 177°, 160° to 175°, 162° to 173°, or 165° to 170° and a contact angle hysteresis of less than 15°, less than 12°, less than 10°, or less than 8°, but no less than 5°.

Figure 3B:
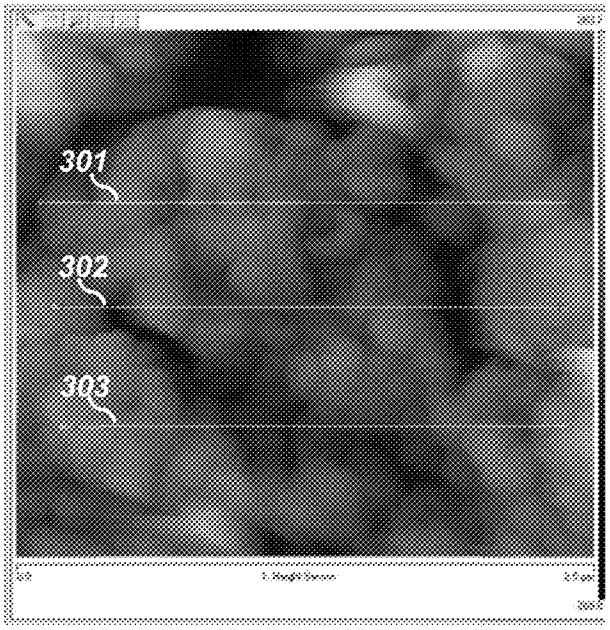
FIG. 3B an atomic force microscopy 2D image of the superhydrophobic and self-cleaning surface.
Figure 3A:
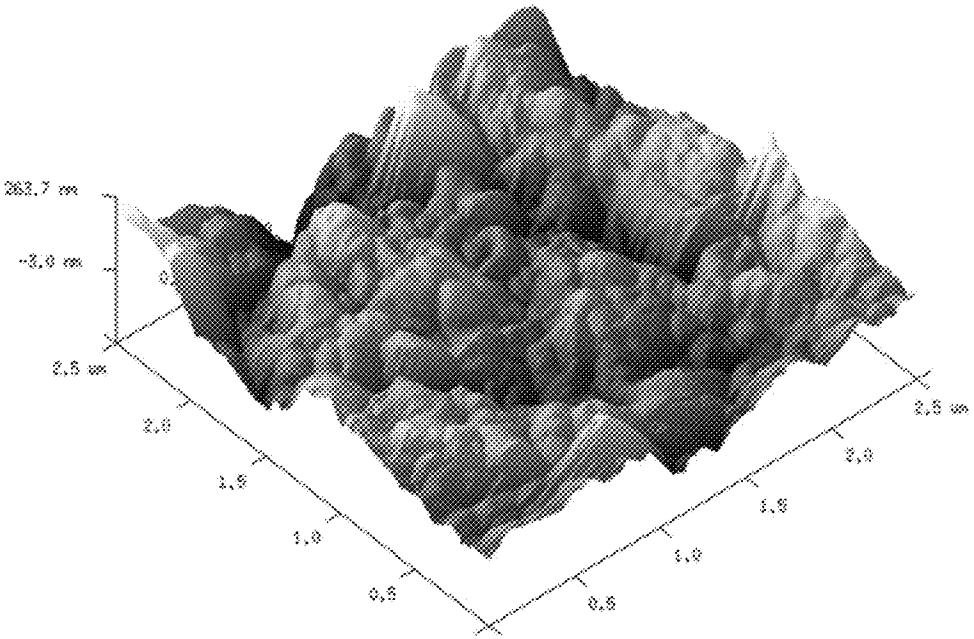
FIG. 3A is an atomic force microscopy 3D image of the superhydrophobic and self-cleaning surface.
Figure 3C:
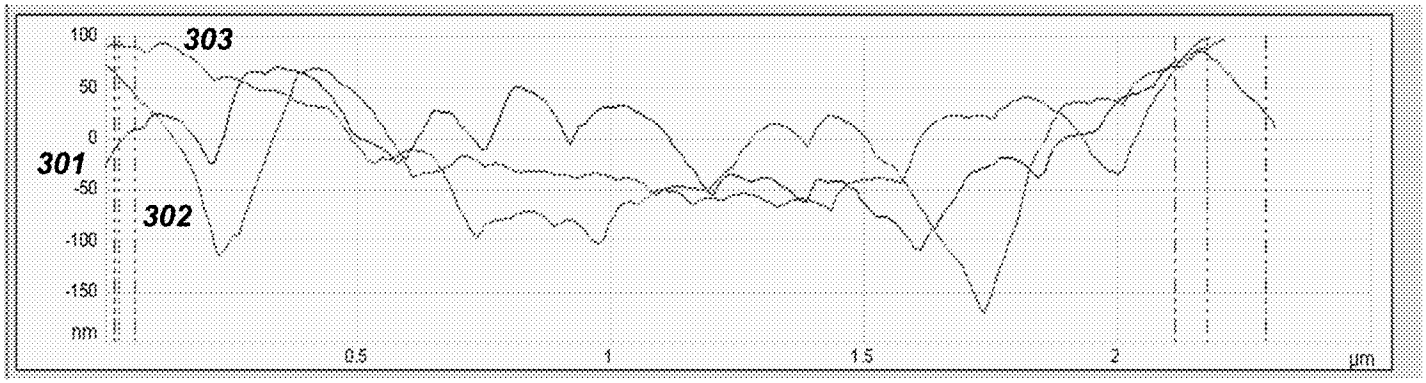
FIG. 3C is a roughness diagram of the atomic force microscopy 3D image of the superhydrophobic and self-cleaning surface.
Figure 3D:
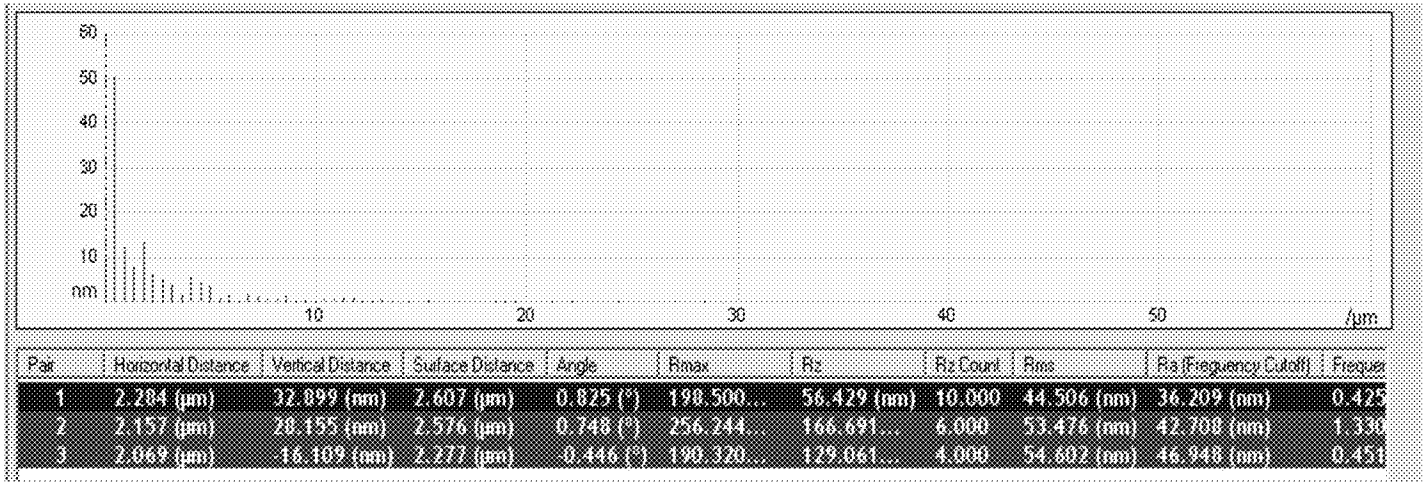
FIG. 3D is the roughness data of the atomic force microscopy 3D image of the superhydrophobic and self-cleaning surface.

An upper 15%, 12%, 10%, or 8% relative to the thickness of the superhydrophobic layer depicts protrusions which appear as peaks and valleys when scanned by atomic force microscopy (AFM) as shown in FIG. 3A, which is taken from the FESEM section shown in FIG. 3B, which corresponds to FIG. 2D. The superhydrophobic layer has protrusions which have a height from peak to valley in the range of 0.9 nm to 500 nm, 10 nm to 450 nm, 50 nm to 400 nm, 75 nm to 350 nm, 100 nm to 300 nm, 150 nm to 250 nm, or 175 nm to 225 nm. In some embodiments, the protrusions have a peak width in the range of 40 nm to 110 nm, 50 nm to 100 nm, 60 nm to 90 nm, or 70 nm to 80 nm. The wide peak widths may indicate that the peaks are the elongated cylindrical fibers. In some embodiments, the substrate exhibits a root mean square roughness of 40 nm to 60 nm or 45 nm to 55 nm which may further indicate the uniformity of the surface as a result of the networks of fibers. While the AFM images appear to show protruding peaks, the varying heights correspond to the SEM in FIG. 2D as networks of fibers which may be moving from the upper part of the superhydrophobic layer into a lower part. Further the valleys may be the pores between the networks of the cylindrical fibers. FIG. 3B, FIG. 3C and FIG. 3D correlate based on the lines 301, 302 and 303. FIG. 3D depicts a table of the roughness measured along lines 301, 302, and 303.

In some embodiments, the superhydrophobic layer may include sub-layers having variable densities. In the superhydrophobic layer there may be 2 to 5 sub-layers or 3 to 4 sub-layers. In some embodiments, each sub-layer may have a thickness of 20 nm-50 nm, 25 nm to 45 nm, 30 nm to 40 nm, or 35 nm to 38 nm. The sub-layer may be formed by methods as described herein in which there may be multiple sub-layers formed. The density of each sub-layer may be controlled by a concentration of the ODTS employed in the formation of each sub-layer by modulating the temperature of drying the sub-layers, as described herein. The density of each sub-layer may be measured in the number of pores per square centimeter (pores/$cm^2$). The density of the sub-layers may be in the range of $1\times10^8$ pores/$cm^2$ to $1\times10^{12}$ pores/$cm^2$, $1\times10^9$ pores/$cm^2$ to $1\times10^{11}$ pores/$cm^2$, or$5\times10^9$ pores/$cm^2$ to $5\times10^{10}$ pores/$cm^2$. In some embodiments, each sub-layer may be in a low density to high density order from closest to the substrate to furthest from the substrate. In some embodiments, the diameter of the cylindrical fibers may be incrcased by higher concentration of the ODTS of the diameter may be reduced by a lower concentration of ODTS. The diameter may be incrcased or decrcased from by 0.5% to 5%, 1% to 4%, or 2% to 3% per 0.05 M change of the concentration of ODTS.

The substrate with a superhydrophobic and self-cleaning surface as described herein may be characterized as self-cleaning. Self-cleaning surfaces have both hydrophobic properties and a micro-rough surface structure. The self-cleaning surface as described herein may exhibit a contact angle hysteresis of less than 15°, less than 12°, or less than 10° when measured with a water droplet. The noodle-like structure may be described as a micro-rough surface resulting in the self-cleaning properties exhibited by the presently described substrate with a superhydrophobic and self-cleaning surface. In some embodiments, the substrate with a superhydrophobic and self-cleaning surface is resistant to particles having a size of at least 0.8 micron, at least 1 micron, at least 1.2 micron, at least 1.5 micron. Resistance to particles may be defined as the ability to resist adhesion or absorbance of particle to the superhydrophobic and self-cleaning surface, and keeping the particle from lodging into spaces between the cylindrical fibers and noodle-like structure. The particles may be, but are not limited to soot, dust, fibers, glass, sand, salt crystals, metal particles, algae, microbes, or mites.

In some embodiments the substrate with a superhydrophobic and self-cleaning surface described herein is resistant to damage from a jet of water or water spray flowing at a flow rate of 5 gpm to 50 gpm, 8 gpm to 40 gpm, or 10 gpm to 30 gpm. Damage to the surface may be defined as a smoothing of the micro-rough surface or breakage of the protrusions formed by the vertically polymerized ODTS, or loss of superhydrophobic and self-cleaning properties. The substrate may resist damage by the flow rate upon an impact angle of 25° to 90°, 30° to 80°, or 40° to 60°.

Superhydrophobic surfaces are useful in a variety of industries and for a variety of purposes, therefore the substrate may be, but is not limited to glass, metals, hard plastic, non-woven fabric, cotton fabric, non-woven synthetic polymer fabric, or a combination thereof. For example, the substrate may include, but is not limited to a printed circuit board, surgical gowns, medical packaging, or filters. Objects which may be comprise the presently disclosed superhydrophobic and self-cleaning substrate are process piping, plumbing, sanitary surfaces, photovoltaic cells in highly dry climates, hospital equipment and surfaces such as flooring and wall tiles, patient bed frames, tables, doors, or medical tubing.

A second aspect of the present disclosure relates to a method of preparing a substrate with a superhydrophobic and self-cleaning surface. The method includes treating a substrate with a plasma treatment under a reduced pressure of 0.5 atm to vacuum, or 0.3 atm to 0.1 atm. Plasma is matter that exists in the form of ions and electrons. Plasma is a result of gas that's been electrically charged with freely moving electrons in both the negative and positive state. Plasma treatment is a result of the molecules, ions, and atoms coming together and interacting with a particular surface. In some implementations, the treating is for 1 minute to 5 minutes or 2 minutes to 4 minutes under the reduced pressure. In some implementations, the plasma treatment may employ oxygen plasma, argon plasma, or nitrogen plasma. In some implementations, the substrate may be treated by hydrofluoric acid etching or sand blasting to clean the substrate before plasma treatment, after plasma treatment, or both.

Following the plasma treatment the substrate is removed from the reduced pressure and the substrate is contacted with water and/or an alcohol to form a hydroxylated substrate. The water and alcohol may be mixed at a volume to volume ratio in the range of 5:1 to 1:5, 4:1 to 1:4, 3:1 to 1:3, or 2:1 to 1:2. The contacting with water and/or an alcohol may be, but is not limited to immersing, pouring, or spraying. The alcohol may be, but is not limited to methanol, ethanol, or isopropanol. A solution of octadecyltrichlorosilane (ODTS) is put into contact with the hydroxylated substrate. The ODTS is prepared in an alkane solvent, preferably hexane, at a concentration in the range of 0.05 M to 0.3 M, 0.1 M to 0.25 M, or 0.15 M to 0.2 M. In some implementations, the alkane is hexane, but may include, pentane, heptane, or a combination thereof. Any combination of hexanes and a second solvent may be in a ratio of hexane to the second solvent in the range of 5:1 to 1:5, 4:1 to 1:4, 3:1 to 1:3, or 2:1 to 1:2. In some implementations the second solvent is not pure and may include water at a percent volume of 0.1% to 8%, 0.5% to 7%, or 2% to 5%. Any water retained in the solvent may aid in the crosslinking between ODTS molecules. The contacting may include, but is not limited to brushing, dipping, spraying, drop-coating, pouring, or spin-coating.

The substrate having the ODTS solution on it is then dried under air to form the superhydrophobic and self-cleaning surface on the substrate. The air may include, but is not limited to ambient air, argon, nitrogen, oxygen, or a combination thereof. In some implementations, the air may include nitrogen at a volume percent relative to the total volume of 60% to 80%, or 65% to 75%, and oxygen at a volume percent relative to the total volume of 10% to 30%, or 15% to 25%. The air, in some implementations may have a relative humidity in the range of 15% to 60%, 20% to 55%, 25% to 50%, or 30% to 45%. In some implementations, the drying is under a heated air stream. The heated air stream may be a temperature in the range of 28° C. to 40° C., 30° C. to 38° C., or 32° C. to 35° C.

After the drying, in some implementations, the method further includes a second contacting of the dried substrate having the ODTS on it with a second solution including an octadecyltrichlorosilane, a reactive polyoctadecylsilane, or a combination thereof, or a combination thereof in an alkane solvent at the concentration as described above and a second drying of the solution under ambient air or under a heated air stream as described herein. A reactive polyoctadecylsilane may include a chloro-group on a terminal silicon atom to react with octadecyltrichlorosilane or a derivative of octadecylsilane (ODS), octadecyldichlorosilanol, octadecylmonochlorosilane-di-ol, or octadecylsilane-tri-ol. In some implementations the contacting and drying may be repeated to obtain sub-layers within the superhydrophobic layer having different densities. The densities of each sub-layer may be determined by the concentration of the ODTS. Higher concentrations may result in a higher density of pores, and the pore size may be reduced by 1%-80%, 5% to 60%, or 25% to 30%, and lower concentrations may result in a lower density of pores, and the pore size may incrcase.

In some implementations, the ODTS may vertically polymerize when deposited on the substrate under ambient air, at 20° to 27° C., and at 1 atm pressure.

Further in some implementations, the temperature of the drying may be employed to control the density of each sub-layer. A higher temperature of drying, such as in a heated air stream, may be able to tune the density. Higher temperatures for drying may incrcase the rate of polymerization leading to an incrcase in pore density by 3%-25%, 5% to 20%, or 10% to 15%.

The examples below are intended to further illustrate the superhydrophobic and self-cleaning surface and are not intended to limit the scope of the claims.

EXAMPLE

Materials

Octadecyltrichlorosilane (ODTS) (>98%, Sigma Aldrich, USA), and hexane (anhydrous, 99%, Sigma Aldrich, USA), and all chemicals were used without any further purification. The ODTS was placed on substrates made of glass micro-slides and plastic holders with removable caps, which were purchased from Somatco Inc., Saudi Arabia.

Surface Modification

Prior to coating, the glass micro-slides and plastic holder substrates were subjected to oxygen plasma treatment to remove any organic contamination present on the surface. The samples were placed inside an Oxygen Plasma Cleaner (Harrick Plasma, Ithaca, N.Y.) and the chamber evacuated with the help of a vacuum pump. After generation of sufficient vacuum (~100 mbar), the plasma was switched on for a period of 2 to 3 minutes. Immediately after, the specimens were removed and immersed in DI water to hydroxylate the surface. The presence of hydroxyl groups on the surface serve as binding sites for the silane to be deposited subsequently.

The ODTS solution was prepared by dissolving the silane in hexane with the help of a magnetic stirrer. The concentration of ODTS in the resulting solution was 0.2 M. The ODTS solution was then poured onto the treated surface drop-by-drop with the help of a disposable dropper. The droplets were added until the solution covered the surface of glass or plastic substrates. The samples were then dried overnight under ambient conditions.

Characterization

Figure 4A:
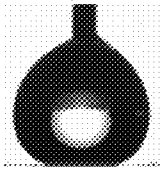
FIG. 4A is a depiction of the advancing edge of an exemplary droplet on a superhydrophobic and self-cleaning surface.
Figure 4B:
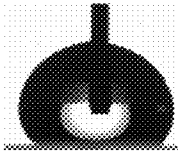
FIG. 4B is a depiction of the receding edge of an exemplary droplet on a superhydrophobic and self-cleaning surface.
Figure 4C:
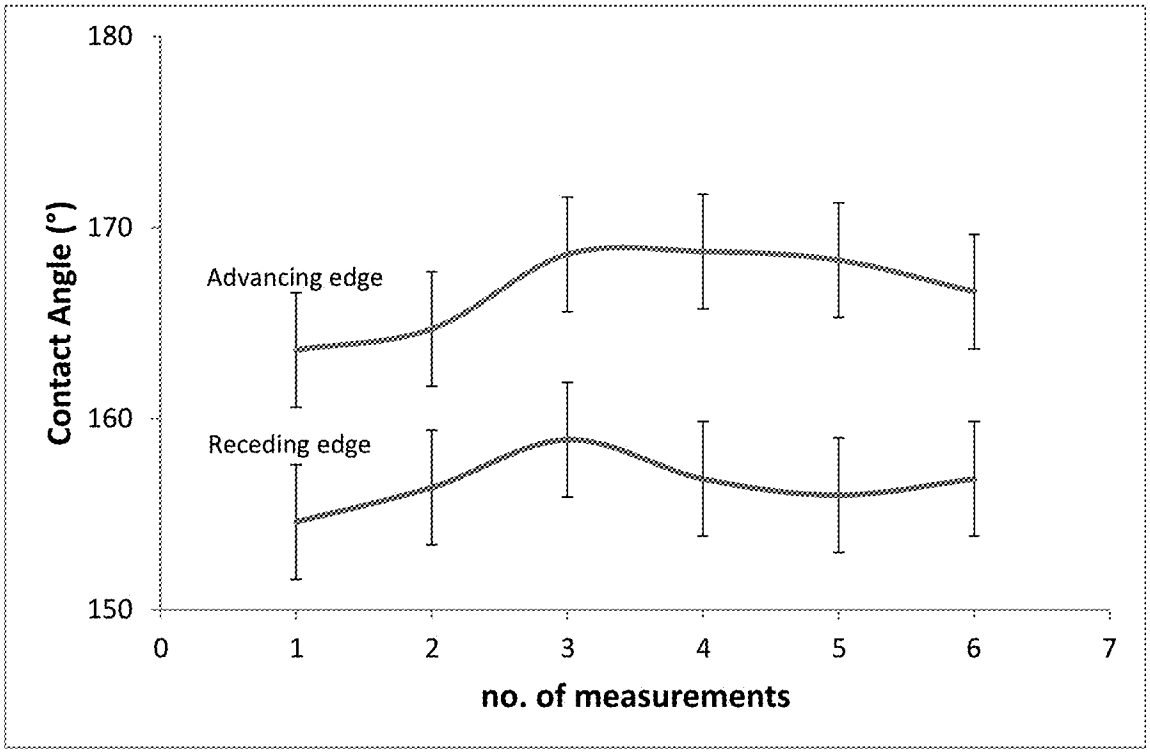
FIG. 4C is a plot of dynamic contact angle measurements of droplets on the superhydrophobic and self-cleaning surface.

Surface morphologies of the coatings were analyzed using a field emission scanning electron microscope (FE-SEM) (Hitachi, S-4800) with images taken from different locations and at various magnifications (FIG. 2A-FIG. 2F). The samples were sputter coated with a very thin film of gold for less than a minute to make them electrically conductive for the microscopy. Optical photographs documented the specimens with water droplets on them (FIG. 5A-FIG. 5D). The water contact angles on the coated surface were measured using a model DM-501 contact angle goniometer (Kyowa Interface Science, Japan) with FAMAS (interFAce Measurement & Analysis System) software. Both static and dynamic (advancing/receding) angles were measured from 5-7 different locations and the mean value calculated. Due to high values of WCAs and the non-spherical shape of the droplet, the tangential method was used to measure the angles from both right and left sides (FIG. 4C).

An assessment of the self-cleaning capabilities of the modified surface was done in the following manner. Dust particles which collected on the surfaces of solar panels were gathered and sprinkled onto the coated specimen. Droplets of DI water were then carefully placed on the surface and the adsorption of dust particles to the droplet was then visually observed (FIG. 6A-FIG. 6F). In practical applications, water is sprayed onto surfaces for cleaning purposes. For this reason, the stability of the silane coating was tested under the impact of an impinging water jet.

Results & Discussion

Surface Morphology

Generally, surfaces with low energy and high roughness demonstrate high water repellency. FIG. 2A-FIG. 2D show FESEM images of the ODTS coating on plastic substrate at different magnifications. The images at lower magnifications (FIG. 2A and FIG. 2B) indicate a very rough surface that is confirmed by AFM measurements on the microscale (FIG. 3A-FIG. 3D). This rough morphology is expected to allow a large amount of air to be entrapped in the rough protrusions which is a principal requirement of superhydrophobicity.

The images at relatively higher magnifications (FIG. 2C and FIG. 2D) indicate the presence of a network of cylindrical fibers with pores in between. The combination of FESEM images at varying resolutions (FIG. 2A-FIG. 2D) confirm the presence of dual scale roughness that is most commonly associated with hierarchical structures for natural superhydrophobic surfaces.

The observed morphology is partially analogous to the surface microstructure of a lotus leaf. Barthlott et al. presented an SEM image of a lotus leaf surface that shows a rough hierarchical structure with cuticles arranged at regular intervals. See Barthlott, W., Neinhuis, C., Purity of the sacred lotus, or escape from contamination in biological surfaces, *Planta,* 202 (1997) 1-8. This morphology is primarily responsible for creating a static water contact angle in excess of 150° and at the same time a sliding angle less than 5°. The entrapped air is a principal requirement of the Cassie Baxter state of wetting resulting in superhydrophobicity.

The pore size can be measured with a good degree of accuracy from images taken at even higher magnifications (FIG. 2E and FIG. 2F). A variation in the size of pores in the range 150 nm-250 nm can be seen in the selected images. However, the mean value was estimated to be about 200 nm. This porous morphology tends to trap air in the pores of the film contributing to the easy rolling of water droplets off the surface. This also implies that the contact model of a water droplet on such a surface is the Cassie-Baxter's model.

The influence of porosity on surface superhydrophobicity was described by several recent studies in which researchers have prepared porous structures to obtain non-wetting surfaces. See Latthe, S. S., Imai, H., Ganesan, V., Rao, A. V., Porous superhydrophobic silica films by sol-gel process, *Microporous and mesoporous Materials.* 130 (2010) p. 115-121, incorporated herein by reference in its entirety. Latthe et al. synthesized porous silica films by sol-gel process as the hydrophobic reagent. Latthe et al. observed a static water contact angle of 160° for a pore size distribution of 250-300 nm. In another study of similar nature, Ganbavle et al. prepared self-cleaning silica coatings on glass using a single-step sol-gel route. See Ganbavle, V. V., Bangi, U. K. H., Latthe, S. S., Mahadik, S. A., Rao, A. V., Self-cleaning silica coatings on glass by single step sol-gel route, *Surface & Coatings Technology,* 205 (2011) 5338-5344, incorporated herein by reference in its entirety.

Surface Topology

Since surface roughness is an important parameter, the surface topology was analyzed using an Atomic Force Microscope from Brukers, Inc. A silicon nitride cantilever was used in the tapping (non-contact) mode with a scan size of 5 μm. The roughness data from AFM scans confirmed the presence of dual-scale roughness suggested by SEM images shown earlier (FIG. 2A-FIG. 2D). The average roughness of the deep valleys in between the protrusions (FIG. 2B) was found to be in excess of 1 micron. On the other hand, the surfaces of the protrusions themselves were between 50 and 100 nm in roughness.

FIG. 3A and FIG. 3B show representative 3-dimensional and 2-dimensional images respectively obtained by scanning inside one of the regions shown in the FESEM image earlier (FIG. 2D). FIG. 3C gives the variation of roughness and a quantitative analysis for three different linear regions selected from FIG. 3B. The root-mean-square (rms) roughness is around 50 nm for all the sections selected which is a good indicator of the uniformity in surface morphology within the protrusions observed in FIG. 2B.

It is interesting to compare the 2-dimensional AFM image (FIG. 3B) with the relevant FESEM micrograph (FIG. 2D) as both represent areas of approximately the same size ~5 μm. The small regions in FIG. 3B next to each other but representing different heights most probably correspond to the fibers and pores in FIG. 2D. The root-mean-square roughness was found to be around 50 nm (FIG. 3C) when roughness was calculated for 3 different linear regions. This value is probably greater than the threshold roughness $r_t$ for air trapping as defined by the Pierre-Gilles de Gennes equation:

$$r_t = 1 + \frac{\tan\theta^2}{4} \tag{1}$$

The above equation decides the range of applicability of Wenzel's or Cassie-Baxter equation: for low surface roughness ($r<r_t$), the contact angle is given by Wenzel equation which assumes that the liquid fills up the protrusions on the rough surface. However, for high roughness ($r>r_t$), the Cassie equation must be used which assumes entrapment of air pockets and the droplet resting on a composite of solid and air. To summarize, surface roughness at both levels (micro and nano) are responsible for the water repellency of the coatings.

Superhydrophobicity

The ultimate measure of superhydrophobicity is static and dynamic water contact angle measurements. The wetting properties of surfaces are commonly described by Young's equilibrium contact angle equation, which is applicable to smooth solid surfaces. However, a majority of surfaces encountered in reality possess intrinsic roughness, either on a micro- or a nanoscale. In such a situation, there are two different models that define the effect of surface roughness on the observed contact angle: the Cassie-Baxter model, which is based on the assumption that air is entrapped in the rough texture underneath the droplet forming a composite air and solid interface, and the Wenzel model that describes a fluid droplet pinned to the rough features of a surface. See T. Young, An essay on the cohesion of fluids, Philos. T. Roy. Soc. London 95(1805) 65-87; A. B. D. Cassie, S. Baxter, Wettability of porous surfaces, T. Faraday Soc. 40 (1944) 0546-0550; R. N. Wenzel, Resistance of solid surfaces to wetting by water, Ind. Eng. Chem. 28 (8) (1936) 988-994, each incorporated herein by reference in their entirety.

FIG. 4C shows the variation of dynamic contact angles (both advancing and receding) for the ODTS modified surface. The smaller pictures show representative images of water droplets for both the advancing (FIG. 4A) and receding angle (FIG. 4B) measurements. The very high contact angles indicate a low surface energy in conjunction with a high surface roughness—a large amount of air was trapped within the interspaces of the coated surface, which pushed the water droplet off. The above findings point to poor adhesion of the water droplet with the surface, thus enabling self-cleaning capabilities.

The contact angle hysteresis (CAH) is an important measure of superhydrophobicity. Many surfaces may show a static or an advancing angle in excess of 150°; however the hysteresis will be too large for imparting self-cleaning properties. For example, studies have reported depositing a monolayer of tridecafluoro-1,1,2,2-tetrahydrooctyldimethylchlorosilane (TFCS) on glass surfaces after initial modification with a sol-gel. Although the advancing angle was well in excess of 150° (~165°), the receding angle was as low as 115°, which meant a hysteresis of 50°. See A. Nakajima, K. Hashimoto, T. Watanabe, K. Takai, G. Yamauchi, A. Fujishima, *Langmuir* 16 (2000) 7044; H. Yabu, M. Shimomura, Single-Step Fabrication of Transparent Superhydrophobic Porous Polymer Films, *Chem. Mater.* 17 (2005) 5231; and G. Gu, H. Dang, Z. Zhang, Z. Wu, Fabrication and characterization of transparent superhydrophobic thin films based on silica nanoparticles, *Appl. Phys. A* 83 (2006) 131, each incorporated herein by reference in their entirety.

Figure 5A:
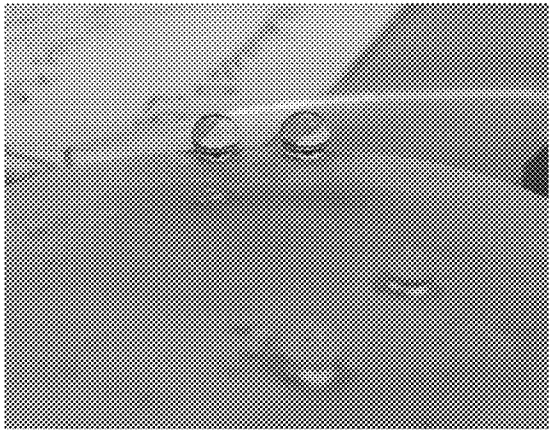
FIG. 5A is an optical image of droplets of water on the superhydrophobic and self-cleaning surface.
Figure 5B:
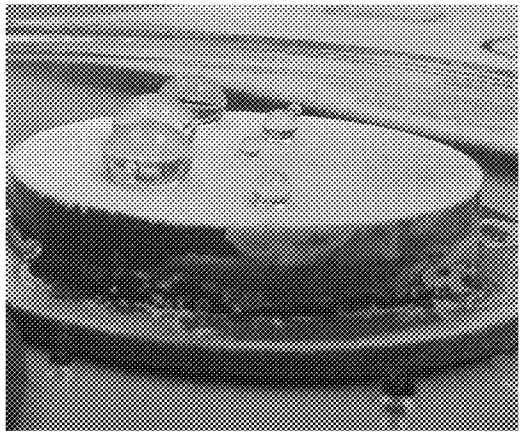
FIG. 5B is an alternate optical image of droplets of water on the superhydrophobic and self-cleaning surface.
Figure 5C:
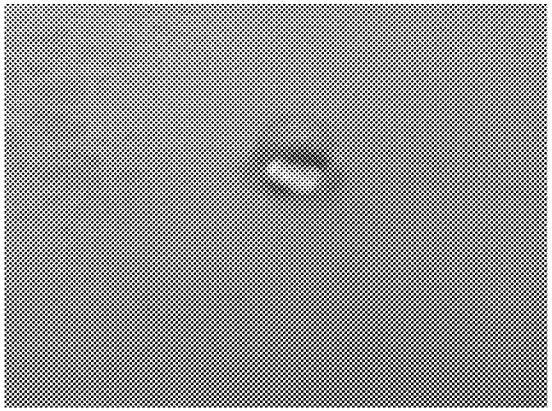
FIG. 5C is an alternate optical image of droplets of water on the superhydrophobic and self-cleaning surface.
Figure 5D:
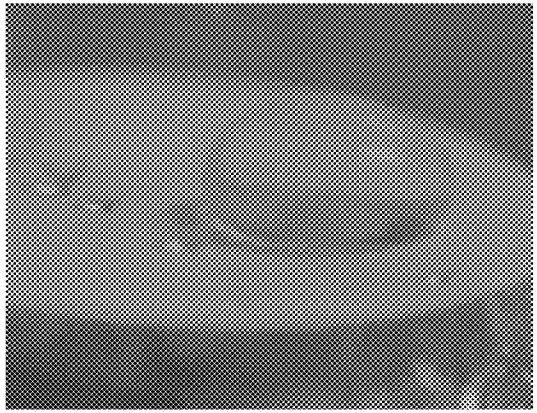
FIG. 5D is an alternate optical image of droplets of water on the superhydrophobic and self-cleaning surface.

Very few studies report low CAH or low sliding angles of the water droplet. See A. Nakajima, K. Abe, K. Hashimoto, T. Watanabe, Preparation of hard superhydrophobic films with visible light transmission, *Thin Solid Films* 376 (2000) 140; A. Duparre, M. Flemming, J. Steinert, K. Reihs, Optical coatings with enhanced roughness for ultrahydrophobic, low-scatter applications, *Appl. Opt.* 41 (2002) 3294; and K. Tadanaga, K. Kitamuro, A. Matsuda, T. Minami, Formation of Superhydrophobic Alumina Coating Films with High Transparency on Polymer Substrates by the Sol-Gel Method, *J. Sol-Gel Sci. Technol.* 26 (2003) 705, each incorporated herein by reference in their entirety. These latter characteristics are required if a surface is to exhibit true self-cleaning properties. In this study, the modified surface consistently showed hysteresis values of less than 10° (FIG. 4C). The contact angle results are very well corroborated by images of water droplets on the ODTS-coated plastic substrate (FIG. 5A-FIG. 5D). The modified surface was so water repellent that many times the water droplets rolled off the surface without even the slightest of tilt. Droplets of different sizes were sat on the surface by careful and precise placement. Small droplets (~10 μl) appeared to have a perfect spherical shape. By continuously adding water to these droplets, large droplets of volume ~1 ml were also created (FIG. 5D).

The droplets maintained their almost spherical shape because, up to a volume of 100 μl, the droplet size was comparable to the capillary length, with the gravitational effect being negligible. However, further addition of water resulted in flattening of the droplets because the hydrostatic force exerted on a small area of the droplet-air interface at the bottom dominated the capillary force. This resulted in a transition from an almost spherical to a nearly elliptical shape of the droplets (FIG. 5D).

Stability & Robustness

In real-world applications, superhydrophobic coatings and surfaces need to have sufficient robustness to maintain their non-wetting characteristics under the impact of water at high pressure e.g. high-speed impact of a water jet. There exist a few of mechanisms that may result in the loss of self-cleaning characteristics: continuous impact of a high-speed water jet may squeeze out the air trapped within the rough structure of a superhydrophobic film and ultimately make the surface more wetting, and/or the coating may be washed away due to their fragile nature and poor adhesion with the substrate. The coating instability under high-pressure water impact restricts the practical applications of such surfaces.

Figure 6A:
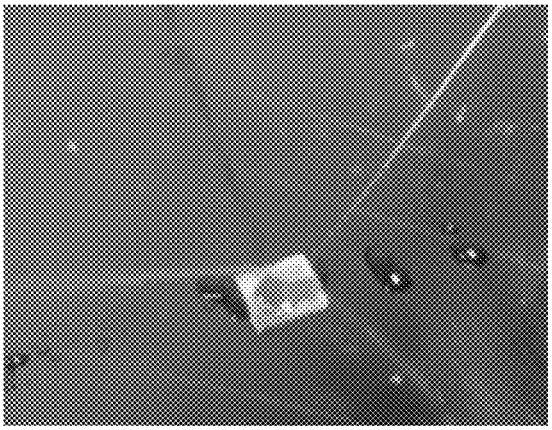
FIG. 6A is an optical image of pressurized water on the superhydrophobic and self-cleaning surface.
Figure 6B:
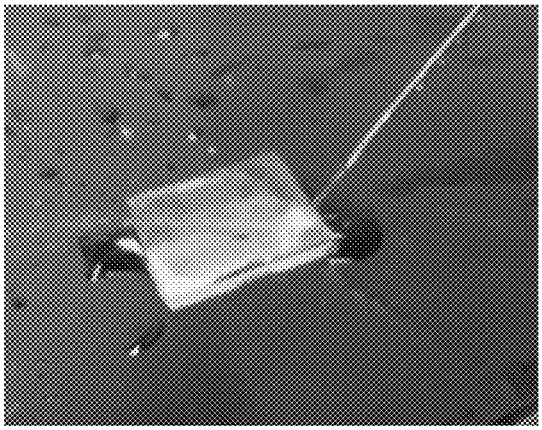
FIG. 6B is an alternate optical image of pressurized water on the superhydrophobic and self-cleaning surface.
Figure 6C:
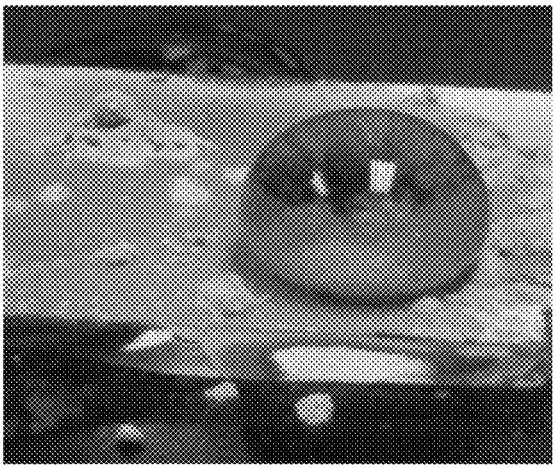
FIG. 6C is an optical image of a water droplet cleaning the dust covered superhydrophobic and self-cleaning surface.

In light of the above, it was deemed valuable to study the impact dynamics of a water jet impinging on the surface to acquire a more precise understanding of the water-repellent properties of the superhydrophobic and self-cleaning surface described herein. FIGS. 6A and 6B show a jet of water produced under normal pressure that impinges on a plastic substrate coated with the ODTS at an angle of ~45°. It was observed that the jet was completely repelled by the surface and reflected at almost the same angle. After this impact even for a long time, no trace of water was left behind and neither the film washed away. Glass and plastic surfaces become dirty very rapidly due to the accumulation of dust particles from the surrounding environment. This problem is very severe in desert regions, where solar collectors and photovoltaic panels experience a significant deterioration in performance and efficiency due to frequent dust accumulation. See S. A. Sulaiman, A. K. Singh, M. M. M. Mokhtar, M. A. Bou-Rabeec, Influence of Dirt Accumulation on Performance of PV Panels, The International Conference on Technologies and Materials for Renewable Energy, Environment and Sustainability, TMREES14, *Energy Procedia* 50 (2014) 50-56 and S. A. M. Said, H. M. Walwil, Fundamental studies on dust fouling effects on PV module performance, *Solar Energy* 107 (2014) 328-337, each incorporated herein by reference in their entirety. However, it is possible to make them self-cleaning by surface modification with a non-wetting coating.

Self-Cleaning Characteristics

Figure 6D:
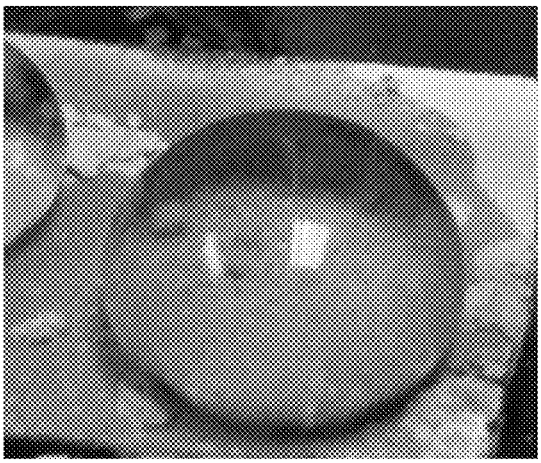
FIG. 6D is an alternate optical image of a water droplet cleaning the dust covered superhydrophobic and self-cleaning surface.
Figure 6E:
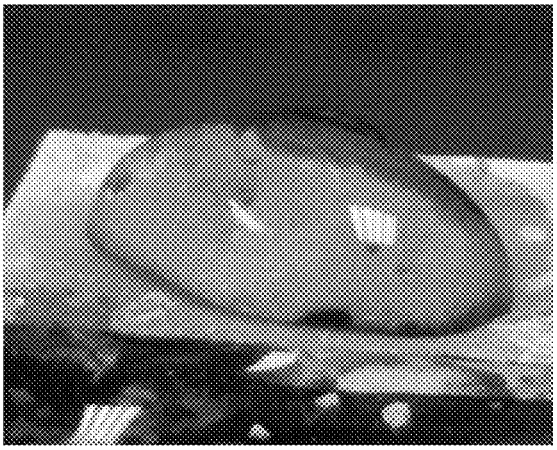
FIG. 6E is an alternate optical image of an elongated water droplet cleaning the dust covered superhydrophobic and self-cleaning surface.
Figure 6F:
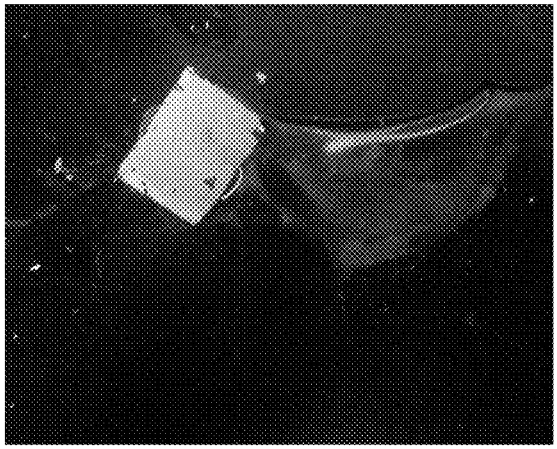
FIG. 6F is an alternate optical image of a water droplet cleaning the dust covered superhydrophobic and self-cleaning surface at low magnification.

The self-cleaning performance of the ODTS film was investigated using dust gathered an active solar panel exposed to the elements. FIG. 6A-FIG. 6D show the self-cleaning functionality of the silane coating on a glass slide. A thin layer of dust particles was sprinkled onto the surface-modified specimen, and then, water was added drop by drop on the contaminated surface. Upon contact with the water droplet, the dust particles were immediately adsorbed showing very little affinity for the thin film. Also, it was observed that the particles clung onto the droplet while it rolled on the surface and were carried away without any trace left behind (FIG. 6D). It is worth mentioning here that this phenomenon occurred with the glass slide perfectly flat without the need for any sliding. A pool of mud accumulated on the surface next to the glass slide (FIG. 6D).

The superhydrophobic and self-cleaning surface as described herein was formed by simple and economical methods. The resulting surface had a combination of low surface energy and roughness that exhibited desirable characteristics of high water-repellency and self-cleaning capability. The average contact angle values were in excess of 150° and the hysteresis which is a crucial indicator of superhydrophobicity was generally less than 10°. Moreover, robustness and stability under the impact of a water-jet was observed. This improves the coating's feasibility to be used in practical applications. The case of synthesis is also a major benefit as scale-up may be simple and straightforward.

Such surfaces may find widespread use in applications such as textiles, antifouling coatings, etc. Future studies may be directed towards testing the stability of these films in accelerated weathering conditions such as controlled UV radiation. Also, it will be interesting to analyze the case of scalability of this synthesis route to determine the feasibility for industrial applications.

The invention claimed is:

1. A method of preparing a superhydrophohic and self-cleaning surface comprising:

plasma treating a glass substrate under a reduced pressure of 0.5 atm to vacuum;

removing the glass substrate from the reduced pressure and contacting the glass substrate with water to form a hydroxylated substrate having a surface with hydroxyl groups;

contacting the hydroxylated substrate with a solution comprising octadecyltrichlorosilane and an alkane solvent, wherein a concentration of the octadecyltrichlorosilane in the alkane solvent is in the range of 0.05 M to 0.3 M to form a superhydrophohic layer which is a 3-dimensional polvsiloxane network of cylindrical fibers having a diameter of 45 nm to 100 nm with pores in between the cylindrical fibers formed from vertical and horizontal polymerization of the octadecyltrichlorosilane, and further wherein the superhydrophohic layer is disposed on and crosslinked to the surface of the glass substrate via the hvrdroxyl groups; and drying the solution on a surface of the hydroxylated substrate under air to form a substrate with the superhydrophobic and self-cleaning surface, and wherein the glass substrate with the superhydrophohic and self-cleaning surface has a root mean square roughness of 40 nm to 60 nm, a water contact angle of 155° to 180°, and a contact angle hysteresis of less than 15°.

2. The method of claim 1, wherein the plasma treating includes at least one selected from the group consisting of an oxygen plasma, an argon plasma treatment, and a nitrogen plasma treatment.

3. The method of claim 1, wherein the alkane is hexane.

4. The method of claim 1, wherein the drying is under a heated air stream.

5. The method of claim 1, wherein the plasma treating is for 1 minute to 5 minutes under a vacuum.

6. The method of claim 1, further comprising repeating the contacting and the drying.

* * * * *